United States Patent [19]

Sakamaki et al.

[11] Patent Number: 4,514,156

[45] Date of Patent: Apr. 30, 1985

[54] ROTARY-SLEEVE BEARING APPARATUS FOR ROTARY COMPRESSOR

[75] Inventors: Hiroshi Sakamaki, Utsunomiya; Yukio Horikoshi, Kazo; Kikuji Yanagihashi, Yono, all of Japan

[73] Assignee: Nippon Piston Ring Co., Ltd., Tokyo, Japan

[21] Appl. No.: 609,994

[22] Filed: May 14, 1984

[30] Foreign Application Priority Data

May 20, 1983 [JP] Japan ..... 58-87737

[51] Int. Cl.[3] ..... F04C 18/348

[52] U.S. Cl. ..... 418/173

[58] Field of Search ..... 418/173

[56] References Cited

U.S. PATENT DOCUMENTS 4,177,024 12/1979 Lohn ..... 418/173 X 4,197,061 4/1980 Hill ..... 418/173

FOREIGN PATENT DOCUMENTS 2107790 5/1983 United Kingdom ..... 418/173

*Primary Examiner*—Leonard E. Smith

*Attorney, Agent, or Firm*—Birch, Stewart, Kolasch & Birch

[57] ABSTRACT

An air-bearing apparatus for use in a movable vane compressor of the type having a rotary sleeve mounted in the center housing for rotation with a plurality of vanes, said apparatus comprising an air-bearing room defined between the inner periphery of the center housing and the outer periphery of the rotary sleeve to floatingly support the rotary sleeve and an air-supply passage to supply air to the air-bearing room from the compression-working space.

In order to increase the bearing performance of the air-bearing room when the compressor runs at high speeds in which the amount of air to be supplied to the air-bearing room exceeds what can be extracted from the compression-working space, the apparatus is provided with an auxiliary passage extending from the discharge chamber to the air-supply passage through a check valve to supply air to the air-bearing room from the discharge chamber.

2 Claims, 2 Drawing Figures

ROTARY-SLEEVE BEARING APPARATUS FOR ROTARY COMPRESSOR

BACKGROUND OF THE INVENTION

1. Field of the Invention

The invention relates to a rotary sleeve bearing apparatus for a rotary compressor in which a rotary sleeve is rotatably mounted in the center housing for rotation with a plurality of vanes and floatingly supported by an air bearing formed between the outer periphery of the rotary sleeve and the inner periphery of the center housing.

2. Description of the Prior Art

A movable vane compressor of the type having a rotary sleeve mounted within an air-bearing room defined between the outer periphery of the rotary sleeve and the inner periphery of the center housing is free from frictional heat and wear at the apex of each vane and, therefore, suitably used as a supercharger for an automobile engine required to run over a wide range of low to high speeds. However, there is the possibility of scuffing and seizing troubles if the rotary sleeve makes a frictional contact with the center housing when it is pushed from within to the inner periphery of the center housing by air compressed in the compression working space confined among the rotary sleeve, the rotor, and the adjacent vanes. From experimental results that the outer periphery of the rotary sleeve contacts the compression side inner periphery of the center housing not on a line but on an area, the inventors of this application have proposed, under Japanese Patent Application Ser. No. Sho 58-28608, that a rotary compressor is provided with an inlet disposed at the starting point of the contact area in the compression side inner periphery of the center housing and an air-supply passage extending from the inlet to the open air, the discharge chamber, or the compression working space whereby air is supplied to the contact area to increase the bearing capacity of the air-bearing room. The inlet is desirably connected to the working space under the maximum pressure to supply the maximum pressure air to the air-bearing room. But, there is a problem that the air supply is insufficient, in volume and pressure, to prevent a direct contact between the rotary sleeve and the center housing when the rotor runs at a rotational speed above a limit in which the amount of air to be supplied to the air-bearing room exceeds what can be extracted from the working space.

SUMMARY OF THE INVENTION

It is the primary object of the invention to provide a rotary sleeve bearing apparatus for a rotary compressor in which an air supply to the air bearing room is sufficient, in pressure and volume, to prevent a direct contact between the rotary sleeve and the center housing even when the compressor runs at speeds higher than a limit in which the air-bearing room needs the amount of air more than what can be extracted from the compression working space.

The apparatus according to the invention comprises an inlet provided on an area in the compression side inner periphery of the center housing to which the rotary sleeve is pushed from within by compressed air, an air-supply passage extending from the compression working space immediately before connected to the discharge chamber, an auxiliary passage extending from the discharge chamber to the air-supply passage, and a check valve provided in the auxiliary passage.

When the rotor runs at speed lower than a limit in which the amount of air to be supplied to the air-bearing room is more than what can be extracted from the compression-working space, air having a pressure higher than the discharge pressure is supplied to the air-bearing room to increase the bearing performance, thereby preventing a direct contact between the rotary sleeve and the center housing. When it runs at speeds higher than the aforementioned limit, the supply of air is also sufficient in pressure and volume to prevent a direct contact between the rotary sleeve and the center housing, because the check valve opens to allow a sufficient air supply through the auxiliary passage to the air-bearing room from the discharge chamber whenever the pressure in the air-supply passage drops below the discharge pressure.

The advantages offered by the invention are mainly that the rotary sleeve smoothly rotates without making a direct contact with the center housing at high running speeds and that the center housing and the rotary sleeve are protected against scuffing and seizing troubles.

BRIEF DESCRIPTION OF THE DRAWINGS

One way of carrying out the invention is described in detail below with reference to drawings which illustrate only one specific embodiment, in which.

DETAILED DESCRIPTION OF THE INVENTION

Figure 1:
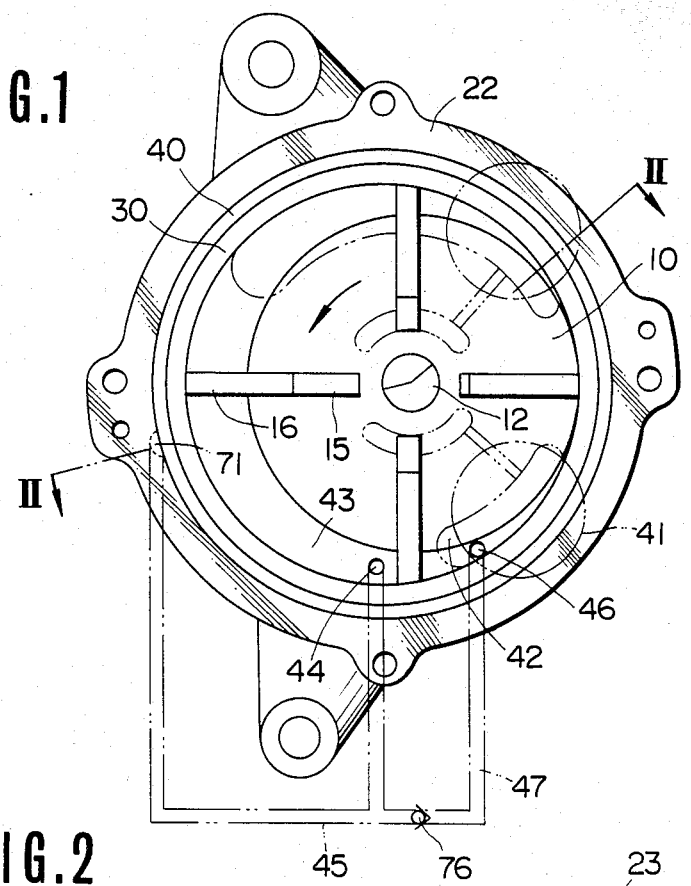
FIG. 1 is a side elevation of the rotary compressor provided with the apparatus of the invention, showing the inside by removal of the side rear housing.

As seen in FIG. 1, a rotor 10 of the rotary compressor is fixed to a rotor shaft 12 and eccentrically disposed in a rotary sleeve 30 to ratate in the direction as indicated by an arrow. The rotor 10 has a plurality of vanes 16 radially movably fitted in the respective vane grooves 15. The vane 16 has its apex in contact with the inner periphery of the rotary sleeve 30. The rotary sleeve 30 is floatingly supported in an air-bearing room 40 confined between the outer periphery of the rotary sleeve and the inner periphery of the center housing 22. The width of the air-bearing room 40 is exaggeratedly illustrated but really less than 0.1 mm.

Two adjacent vanes 16, while turning, forms a compression-working space 43 in the compression side of the compressor. The compression working space 43 has its maximum pressure immediately before internally connected to the discharge chamber 41 through the discharge port 42. An extract port 44 is provided to extract the maximum pressure air from the compression working space and the other extract port 46 is provided in the discharge chamber 41. An inlet 71 is provided at the starting point of an area to which the rotary sleeve 30 is pushed from within by the compressed air in the compression working space 43. The inlet 71 is connected to the extract port 44 with the intervention of an air-supply passage 45 which is connected to the other extract port 46 through an auxiliary passage 47 provided with a check valve 76. The both passages 45, 47 are formed in the center housing but illustrated by imaginal lines as were outside the housing for convenience of understanding.

Figure 2:
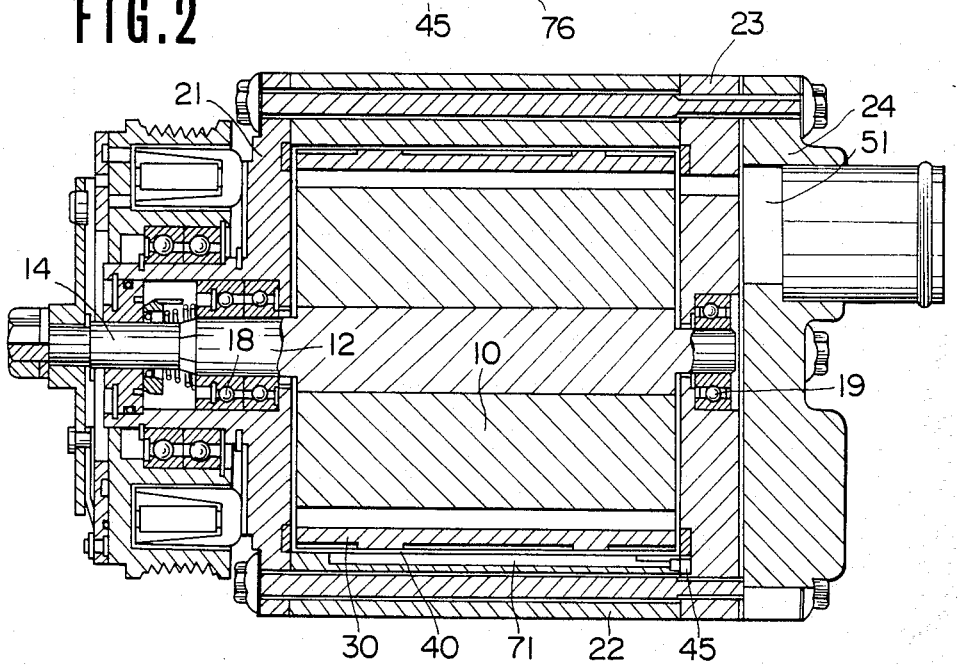
FIG. 2 is a somewhat reduced section taken along lines II—II of FIG. 1.

As seen in FIG. 2, the rotor 10 is integrally shaped with a shaft 12 which is rotatably supported by bearings 18, 19 in the respective front and rear side housings 21, 23. The shaft 12 is fixed at the front end thereof to a pulley 14 which is rotated by an engine. A gasket is interposed between the rear side housing 23 and the rear cover 24 in which the discharge chamber and the suction chamber 51 are provided. The air-supply passage 45 opens to the air-bearing room 40 between the center housing 22 and the rotary sleeve 30 through the inlet 71 at the starting point of the area to which the rotary sleeve 30 is pushed from within by the compressed air.

Upon rotation of the rotor 10 of the compressor of FIGS. 1 and 2, air is gradually compressed in the compression working space 43 defined between the two adjacent vanes 16 to have is maximum pressure immediately before the compression working space 43 is internally connected to the discharge chamber 41. The maximum-pressure air is extracted through the extract port 44 to the air-supply passage 45 and supplied to the air-bearing room 40 from the inlet 71 at the starting point of the area to which the rotary sleeve 30 is pushed from within by the compressed air in the working space 43 so as to increase the bearing ability of the room. The increased air-flowing on the area prevents a direct contact between the rotary sleeve 30 and the center housing 22 when the rotary sleeve 30 is pushed to the area by the high-pressure air in the compression-working space 43. When the rotor rotates at speeds lower than a limit in which the amount of air to be supplied to the air-bearing room 40 needs more than what can be extracted from the compression-working space 43, the air, having a pressure higher than the discharge pressure, is supplied to increase the bearing capacity of the air-bearing room 40 with the result that the rotary sleeve 30 is prevented from frictionally contacting the center housing 22.

When the rotor rotates at speeds higher than the aforementioned limit, the pressure in the air-supply passage 45 is caused to drop below the discharge pressure, só that the check valve 76 opens to allow air supply to the air-bearing room 40 from the discharge chamber 41. The discharge chamber 41 can supply a sufficient air, in volume and pressure, to the bearing room 40, although its pressure is lower than the maximum pressure in the working space. Thus, the air-bearing room 40 is capable to prevent a direct contact between the rotary sleeve 30 and the center housing 22.

From the foregoing, the apparatus of the invention supplies the maximum-pressure air to the air-bearing room to increase the bearing capacity thereof and prevent a direct contact between the rotary sleeve and the center housing when the rotor runs at low to middle speeds. It also supplies the discharge-pressure air to the air-bearing room from the discharge chamber to prevent a direct contact between the center housing and the rotary sleeve when the rotor rotates at high speeds in which the air-bearing room needs more than what can be extracted from the working space. This is resulted from that the check valve in the auxiliary passage opens to allow an additional supply of air to the air-bearing room from the discharge chamber whenever the air-supply passage has a pressure below the discharge pressure.

What is claimed is:

1. A rotary-sleeve bearing apparatus for rotary compressor provided with a center housing, a rotary sleeve rotatably mounted in said center housing, a rotor disposed within said rotary sleeve, a plurality of vanes movably fitted in said rotor, and a discharge chamber, said apparatus comprising a thin air-bearing room defined between the inner periphery of said center housing and the outer periphery of said rotary sleeve, an inlet provided on the compression-side inner surface of said center housing, and an air-supply passage extending from a compression working space immediately before internally connected to said discharge chamber, said air-supply passage being connected to said discharge chamber through an auxiliary passage provided with a check valve.

2. The apparatus as claimed in claim 1, wherein said inlet is disposed at the starting point of an area to which said rotary sleeve is pushed from within by the compressed air in said compression-working space.

* * * * *